US009176481B2

(12) United States Patent
Oshio

(10) Patent No.: US 9,176,481 B2
(45) Date of Patent: Nov. 3, 2015

(54) TIMEPIECE

(75) Inventor: Takumi Oshio, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 81 days.

(21) Appl. No.: 13/600,471

(22) Filed: Aug. 31, 2012

(65) Prior Publication Data

US 2013/0051201 A1 Feb. 28, 2013

(30) Foreign Application Priority Data

Aug. 31, 2011 (JP) ..... 2011-189499
Aug. 31, 2011 (JP) ..... 2011-189500

(51) Int. Cl.

*G04B 37/00* (2006.01)
*G04G 17/08* (2006.01)
*G04B 37/08* (2006.01)
*G04B 37/11* (2006.01)

(52) U.S. Cl.

CPC ..... *G04G 17/08* (2013.01); *G04B 37/00* (2013.01); *G04B 37/005* (2013.01); *G04B 37/08* (2013.01); *G04B 37/11* (2013.01)

(58) Field of Classification Search

CPC ..... G04B 37/00; G04B 37/005; G04B 37/04; G04B 37/05; G04B 37/08; G04B 37/11; G04G 17/08
USPC ..... 368/281, 291, 309, 294
See application file for complete search history.

(56) References Cited

U.S. PATENT DOCUMENTS 2,737,010 A 3/1956 Piquerez
2,858,663 A 11/1958 Schwarz
3,557,548 A * 1/1971 Yoshiaki ..... 368/291
4,497,584 A * 2/1985 Ratajski ..... 368/294
6,170,982 B1 1/2001 Graber
6,406,178 B1 6/2002 Luscher et al.
2003/0016591 A1* 1/2003 Meyrat et al. ..... 368/309
2005/0243654 A1 11/2005 Dufour et al.
2006/0126438 A1* 6/2006 Itou et al. ..... 368/47
2006/0164924 A1* 7/2006 Arai et al. ..... 368/281
2007/0145197 A1* 6/2007 Hiranuma et al. ..... 248/27.1
2007/0147185 A1* 6/2007 Hiranuma et al. ..... 368/311

FOREIGN PATENT DOCUMENTS

CH 258894 A 12/1948
CH 287618 A 12/1952

(Continued)

OTHER PUBLICATIONS

The extended European Search Report for European Application No. 12181982.5 mailed Nov. 4, 2013.

(Continued)

*Primary Examiner* — Amy Cohen Johnson
*Assistant Examiner* — Matthew Powell
(74) *Attorney, Agent, or Firm* — Global IP Counselors, LLP

(57) ABSTRACT

To provide a timepiece which is easy to produce, a timepiece includes a case forming a ring shape; a back cover fitted to a back side of the case, and a fixing member forming a ring shape running along the circumferential direction of an inner peripheral part of the case, and having a fixing function for fixing the back cover to the case. The case is harder than the fixing member. The fixing member is disposed between the case and the back cover, and is compressed and deformed therebetween, thereby making it possible to fulfill the fixing function.

10 Claims, 12 Drawing Sheets

(56) References Cited

FOREIGN PATENT DOCUMENTS

| | | | |
|---|---|---|---|
| CH | 646570 | A3 | 12/1984 |
| EP | 0841602 | A1 | 5/1998 |
| EP | 2182416 | A1 | 5/2010 |
| JP | 57-142385 | U | 9/1982 |
| JP | 58-060286 | U | 4/1983 |
| JP | 2010-127765 | A | 6/2010 |

OTHER PUBLICATIONS

The partial European Search Report for European Application No. 12181982.5 mailed Dec. 17, 2012.

* cited by examiner

TIMEPIECE

CROSS-REFERENCE TO RELATED APPLICATIONS

This application claims priority to Japanese Patent Application No. 2011-189499 filed on Aug. 31, 2011 and Japanese Patent Application No. 2011-189500 filed on Aug. 31, 2011. The entire disclosure of Japanese Patent Application Nos. 2011-189499 and 2011-189500 is hereby incorporated herein by reference.

BACKGROUND

1. Technical Field

The present invention relates to a timepiece.

2. Background Technology

One well-known wristwatch is provided with a case forming a ring shape, and a back cover mounted onto a back side of the case (for example, see Patent Citation 1). With the wristwatch recited in Patent Citation 1, the back cover is fixed to the case via a bolt (screw). When the wristwatch is produced in this manner, a bolt must be used to screw the back cover and the case together, and a problem is presented in that this production work is laborious and in that the bolt can loosen during the work.

Further, with the wristwatch as set forth in Patent Citation 1, a metal material or ceramic is used as a constituent material of the case. In a case where a metal material is used as the constituent material, an internal screw thread into which an external screw thread of the bolt is screwed can be formed directly on the case, but forming the internal screw thread on the case is difficult in a case where a ceramic is used. For this reason, a metal tube in which a internal screw thread has been formed on an inner peripheral part is embedded in the case, and the internal screw thread of this metal tube and the external screw thread of the bolt are screwed together. When the metal tube of such description is used, problems in terms of production are presented in that the number of parts is thereby increased, there is the additional step of embedding the metal tube, and the like.

Also, with the wristwatch recited in Patent Citation 1, as described previously, the back cover is fixed to the case via the bolt. This bolt is locked in toward the back cover from the outside of the case. For this reason, a head part of the bolt (a screw head) is exposed, and a problem is presented for the wristwatch in that the aesthetic appearance is adversely affected.

Japanese Laid-open Patent Application No. 2010-127765 (Patent Document 1) is an example of the related art.

SUMMARY

Problems to be Solved by the Invention

A first advantage of the invention is to provide a timepiece which is easy to produce. A second advantage of the invention is to provide a timepiece having a superior aesthetic appearance.

Means Used to Solve the Above-Mentioned Problems

The first advantage of such description is achieved by the following first to eighth aspects of the invention.

A timepiece of a first aspect of the invention is provided with:

a timepiece case forming a ring shape, a back cover mounted onto a back side of the timepiece case; and a fixing member for fixing the back cover to the timepiece case, the fixing member forming a ring shape running along a peripheral direction of an inner peripheral part of the timepiece case; wherein:

the timepiece case is of a harder material than the fixing member; and the fixing member is disposed between the timepiece case and the back cover, and is compressed and deformed between the timepiece case and the back cover to thereby exert a fixing function.

The fixing member having been compressed and deformed is thereby imparted with a reaction force attempting to return to the original shape. This reaction force increases the fixation force for fixing the timepiece case and back cover together, and reliably fixes the back cover to the timepiece case. In this manner, according to the timepiece, a simple configuration in which the fixing member is compressed and deformed between the timepiece case and the back cover can be used to readily and reliably mount the back cover onto the timepiece case. Accordingly, it can be concluded that the timepiece is easy to produce.

According to a preferred second aspect of the invention, in the timepiece, the back cover has a projecting part formed so as to project on a front-side surface; and the fixing member is compressed and deformed between the inner peripheral part of the timepiece case and the projecting part. This makes it possible to reliably compress and deform the fixing member between the inner peripheral part of the timepiece case and the projecting part in a thickness direction thereof, and possible to thereby more reliably exert the fixing function of the fixing member.

According to a preferred third aspect of the invention, in the timepiece, the fixing member is fixed to the inner peripheral part of the timepiece case in advance; and the fixing member and/or the projecting part has a guide part for guiding the projecting part to the inner peripheral part of the fixing member when the back cover is being mounted onto the timepiece case. This makes it possible to reliably guide the back cover to such a position that the projecting part can compress the fixing member against the inner peripheral part of the case, and facilitates the mounting work, when the back cover is mounted onto the case when the timepiece assembly is being produced.

According to a preferred fourth aspect of the invention, in the timepiece, the projecting part is a portion forming a ring shape running along an edge part of the back cover. This makes it possible for the projecting part to reliably compress and deform the entirety of the fixing member in the width direction against the inner peripheral part of the timepiece case, and accordingly, possible to more reliably exert the fixing function of the fixing member.

According to a preferred fifth aspect of the invention, in the timepiece, the timepiece case has a fixing member installation part constituted of a wide diameter part where an inner diameter has been widened in the inner peripheral part of the timepiece case, the fixing member installation part being where the fixing member is installed. The fixing member is thereby made to be fitted together with the fixing member installation part when, for example, the inner diameter of the fixing member installation part is set to be substantially equivalent to the outer diameter of the fixing member, and, accordingly, the fixing member is thereby more reliably fixed to the fixing member installation part, and detachment from the fixing member installation part is thereby reliably prevented.

According to a preferred sixth aspect of the invention, in the timepiece, a concave part into which a part of the fixing member enters when the fixing member has been compressed and deformed is formed on the timepiece case and/or the back cover. This makes it possible to prevent the fixing member from being excessively deformed when the fixing member is compressed and deformed. The configuration is also effective when there is a desire to suppress an increase in the fixation force caused by the fixing member between the timepiece case and the fixing member, i.e., when there is a desire to relieve the fixation force.

According to a preferred seventh aspect of the invention, in the timepiece, the timepiece case is constituted of a ceramic or metal material, and the fixing member is constituted of a resin material. The timepiece case is thereby imparted superior aesthetic appearance, strength, and the like when the timepiece case is constituted of, for example, a ceramic. Although the fixing member is deformed when compressed between the case and the back cover, the use of a resin material for the fixing member makes it possible to reliably create a reaction force seeking to return to the original shape at such a time, and also possible to exert a fixing function.

According to a preferred eighth aspect of the invention, in the timepiece, the back cover is constituted of a plurality of members constituted of mutually different bodies, and is made by bonding the members to each other. Electrical eddy currents will occur in the back cover when the timepiece is an electrical timepiece (a radio timepiece) having an antenna for receiving GPS positioning radio waves from a GPS satellite. A property of electrical eddy currents resides in changing, i.e., in becoming larger or becoming smaller, in accordance with the magnitude of volume of a member in which an electrical eddy current occurs. For this reason, it is preferable that the size of a member in which an electrical eddy current occurs be as small as possible. In view whereof, the back cover is made by bonding to each other a plurality of members constituted of mutually different bodies, whereby even though electrical eddy currents can occur at a plurality of points on the back cover, i.e., in each of the members, the magnitude of each of the electrical eddy currents can be kept relatively low.

The second advantage of such description is achieved by the following ninth through sixteenth aspects of the invention. In a ninth aspect of the invention, a timepiece is provided with: a timepiece case forming a ring shape;

a back cover mounted onto a back side of the timepiece case; and a fixing unit for fixing the back cover to the timepiece case, wherein the fixing unit has: at least one engaging piece disposed on one member among either the timepiece case or the back cover, within a space surrounded by the timepiece case and the back cover;

a fixing member for fixing the engaging piece to the one member within the space; and an engaging part for engaging with the engaging piece, the engaging part being provided to the other member from among the timepiece case and the back cover.

The fixing member for fixing the timepiece case and the back cover is thereby arranged within the space surrounded by the timepiece case and the back cover, and thereby cannot be seen from the outside. This allows the timepiece to have a superior aesthetic appearance and an enhanced beauty.

According to preferred tenth aspect of the invention, in the timepiece, the back cover has a projecting part formed so as to project on a front-side surface; and the engaging piece is disposed on a top part of the projecting part. This makes it possible for the engaging piece to be disposed such that a part thereof projects farther outward than the projecting part. Further, this projected portion of the engaging piece can engage with the engaging part. According to a preferred eleventh aspect of the invention, in the timepiece, the projecting part is a portion forming a ring shape running along an edge part of the back cover. In a case where there are a plurality of the engaging pieces disposed at a top part of rib, this makes it possible for the engaging pieces to be disposed at equal intervals along the circumferential direction of the rib. Also, disposing the same in this manner makes it possible to evenly disperse the engaging force imparted by the plurality of the engaging pieces; the back cover is accordingly mounted onto the case in a stable manner.

According to a preferred twelfth aspect of the invention, in the timepiece, the engaging part is constituted of a concave part formed on an inner peripheral part of the timepiece case. This makes it possible for the concave part to be a portion having a ring shape running along the inner peripheral part of the timepiece case. Also, the engaging piece can be handled at any position in the circumferential direction, it being possible to insert a part of the engaging piece into the concave part having the shape of such description. This makes it possible to readily and reliable engage the engaging piece with the engaging part constituted of the concave part.

According to a preferred thirteenth aspect of the invention, in the timepiece, the engaging piece clamps a part of the timepiece case against an edge part of the back cover. The fixing function in the fixing unit is thereby enhanced, i.e., the fixing force is thereby increased, in proportion to the clamping; accordingly, the back cover having been mounted onto the timepiece case can be reliably prevented from unwanted detachment.

According to a preferred fourteenth aspect of the invention, in the timepiece, there are a plurality of the engaging pieces disposed about a central axis of the timepiece case. This makes it possible for the plurality of the engaging pieces to be disposed at equal angular intervals about the central axis of the timepiece case. Disposing the same in this manner makes it possible to evenly disperse the engaging force imparted by the plurality of the engaging pieces; accordingly, the back cover can be reliably mounted onto the case in a stable manner.

According to a preferred fifteenth aspect of the invention, in the timepiece, the fixing member is a bolt. One member has a internal screw thread into which the bolt is screwed and which is formed at a position where the engaging piece is arranged. Screwing the bolt into this internal screw thread reliably fixes the engaging piece to the one member. Using the bolt as the fixing member in this manner makes it possible to readily and reliably fix the engaging piece through a simple configuration (task) of "screwing together".

According to a preferred sixteenth aspect of the invention, in the timepiece, the timepiece case and the back cover are constituted of mutually different materials. This makes it possible to use constituent materials respectively adapted to the timepiece case and the back cover. For example, a ceramic having superior aesthetic appearance and/or strength can be used as the constituent material of the case, and, for example, stainless steel, which can earth (ground) the movement, can be used for the back cover.

Effect of the Invention

According to the invention, a timepiece is easy to produce. Further, according to the invention, a timepiece can be endowed with superior aesthetic appearance.

BRIEF DESCRIPTION OF THE DRAWINGS

Referring now to the attached drawings which form a part of this original disclosure.

DETAILED DESCRIPTION OF EXEMPLARY EMBODIMENTS

Provided below is a more detailed description of the timepiece of the invention, on the basis of the preferred embodiments illustrated in the accompanying drawings.

First Embodiment

Figure 1:
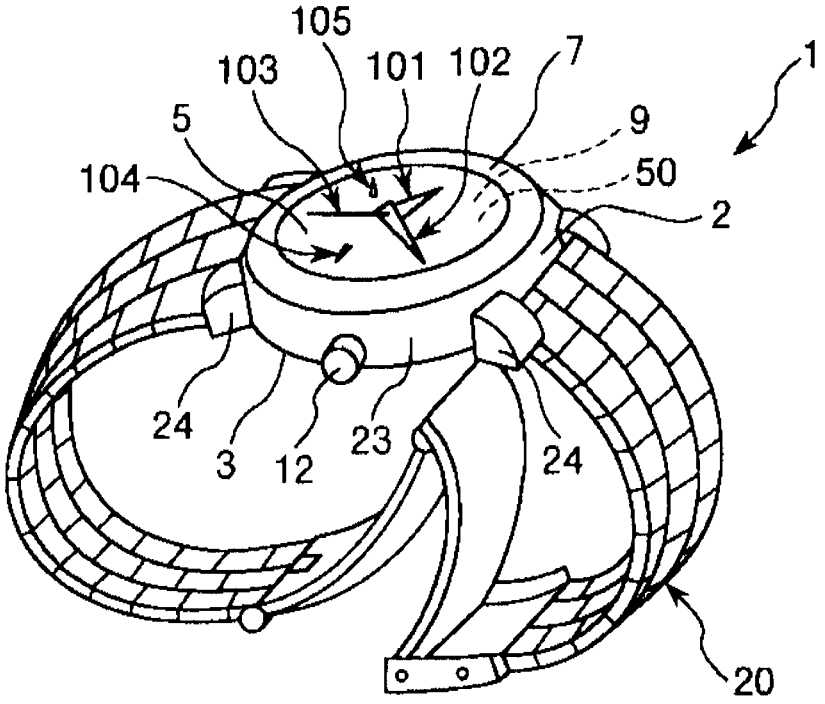
FIG. 1 is a perspective view for illustrating a first embodiment of a case where the timepiece of the invention has been adopted in a wristwatch.
Figure 2:
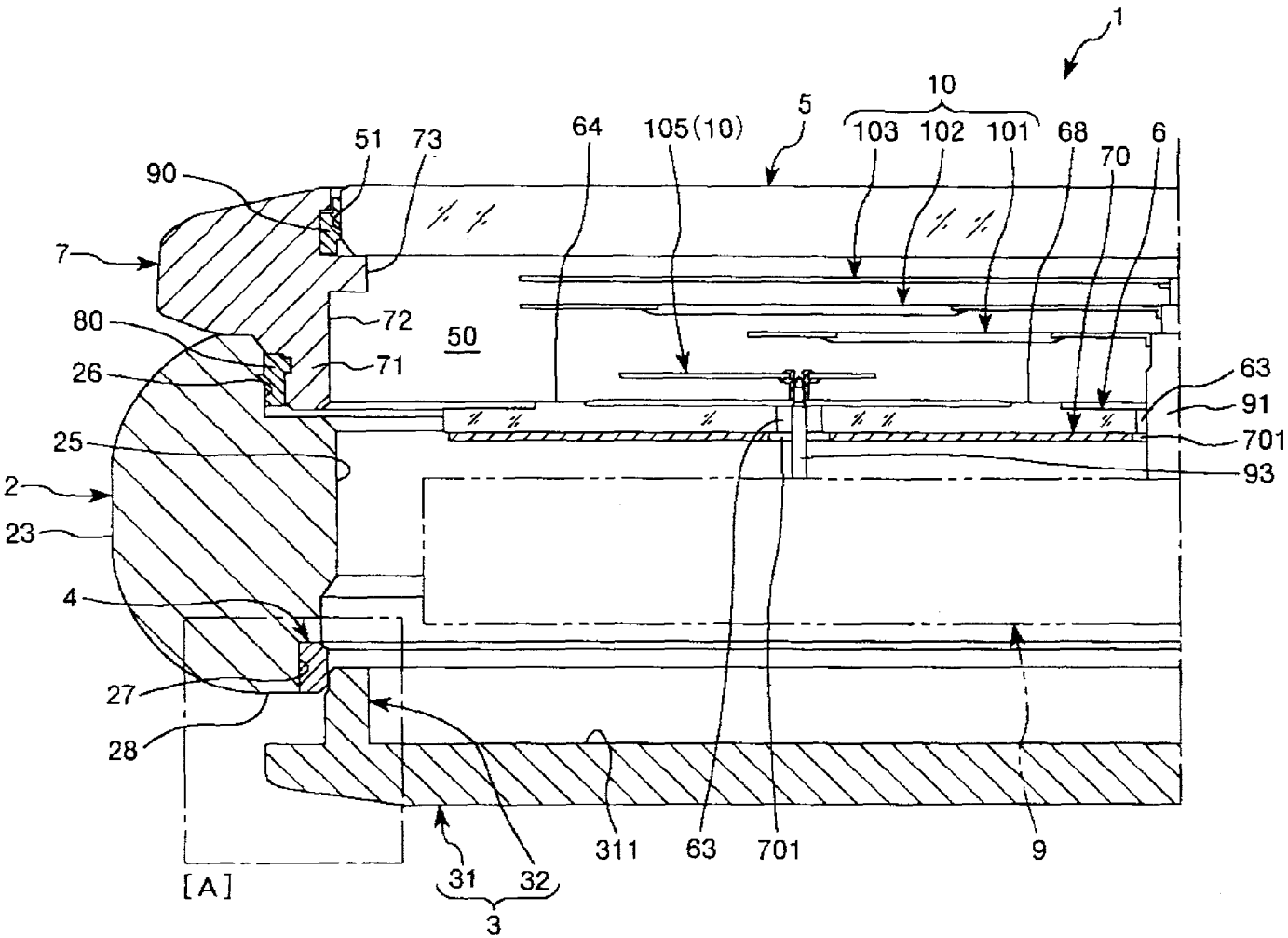
FIG. 2 is a cross-sectional view illustrating, in order, a process until a point when a back cover is fixed to a timepiece case via a fixing member in the wristwatch illustrated in FIG. 1.
Figure 3:
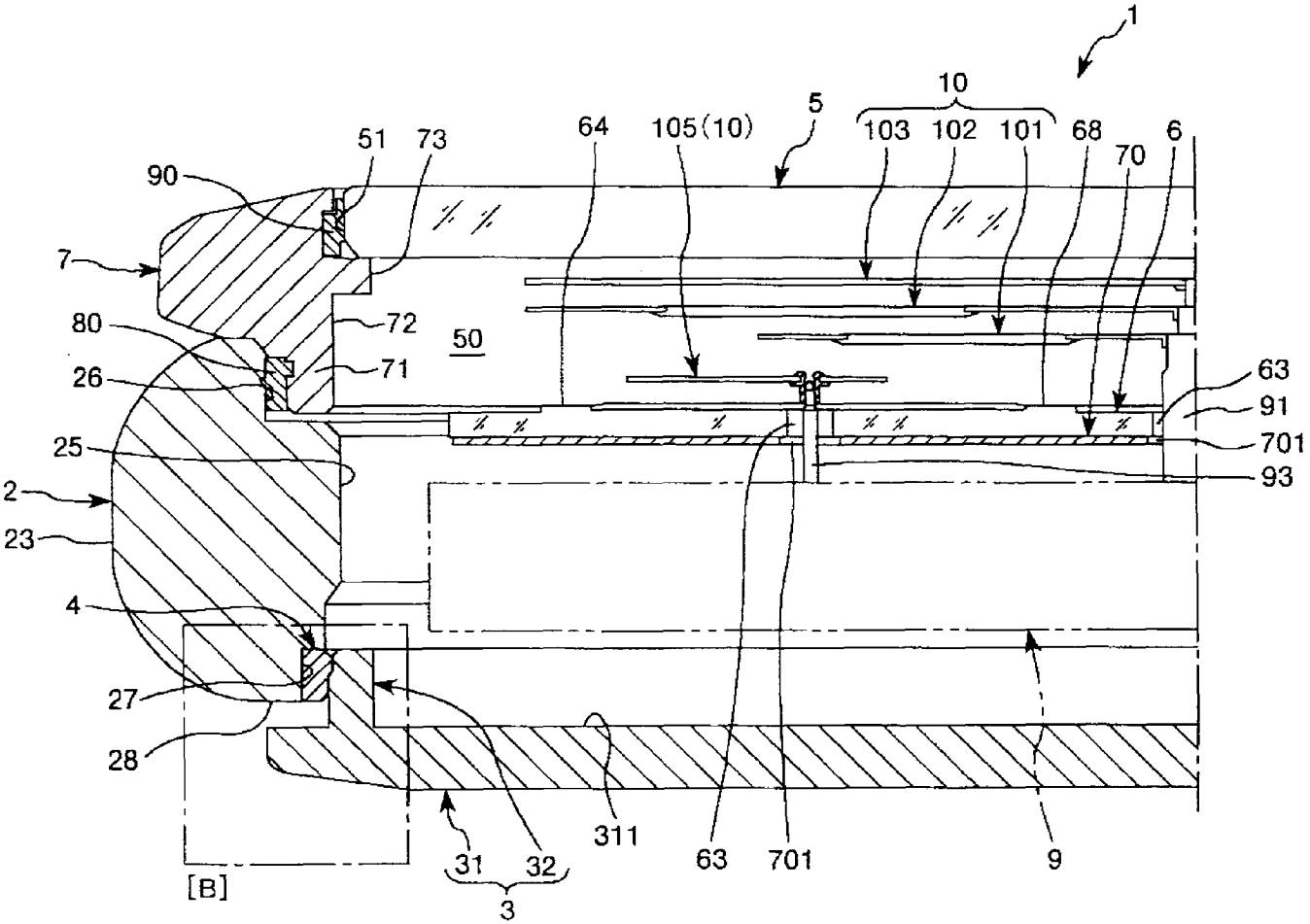
FIG. 3 is a cross-sectional view illustrating, in order, the process until the point when the back cover is fixed to the timepiece case via the fixing member in the wristwatch illustrated in FIG. 1.
Figure 4:
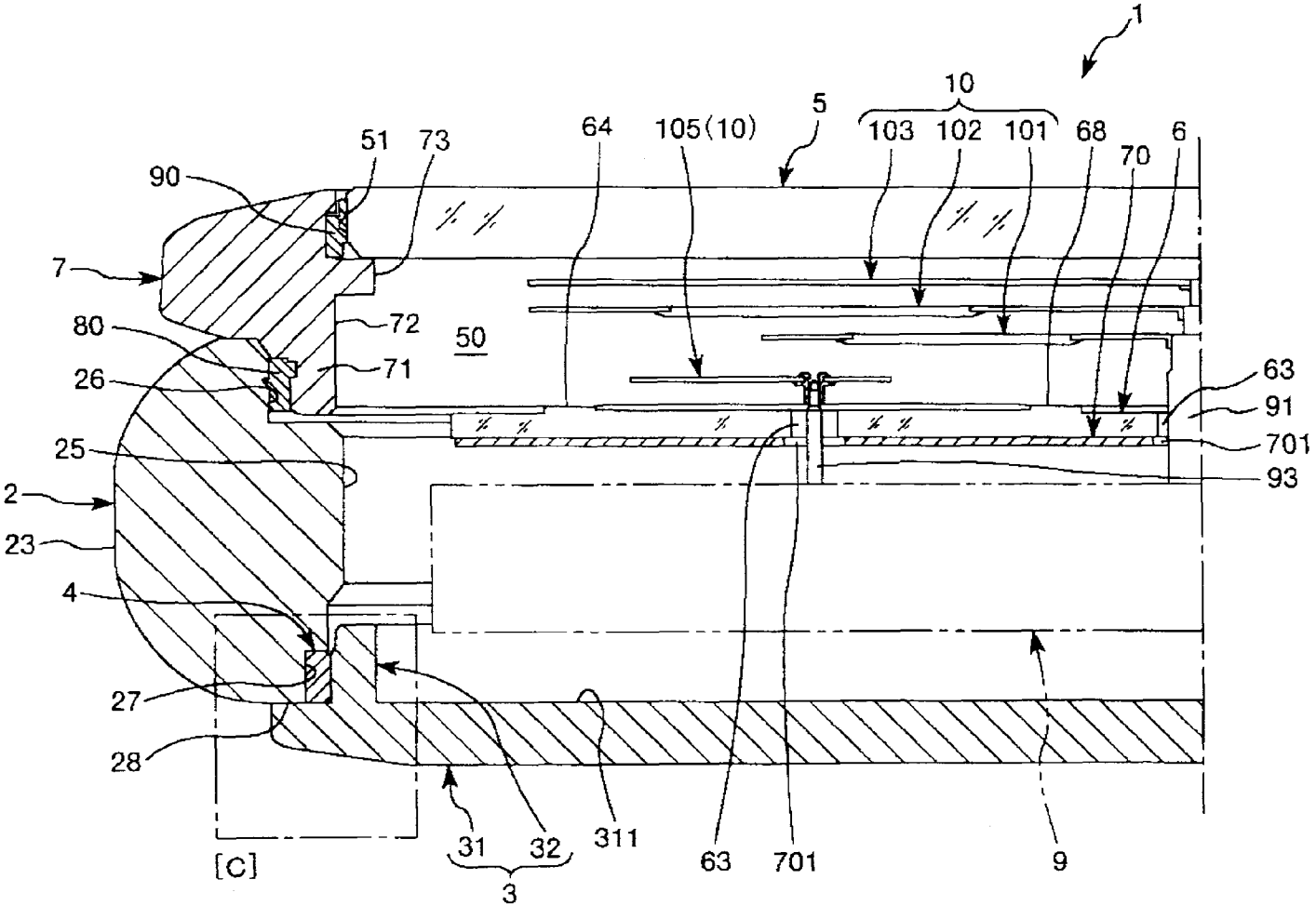
FIG. 4 is a cross-sectional view illustrating, in order, the process until the point when the back cover is fixed to the timepiece case via the fixing member in the wristwatch illustrated in FIG. 1.
Figure 5:
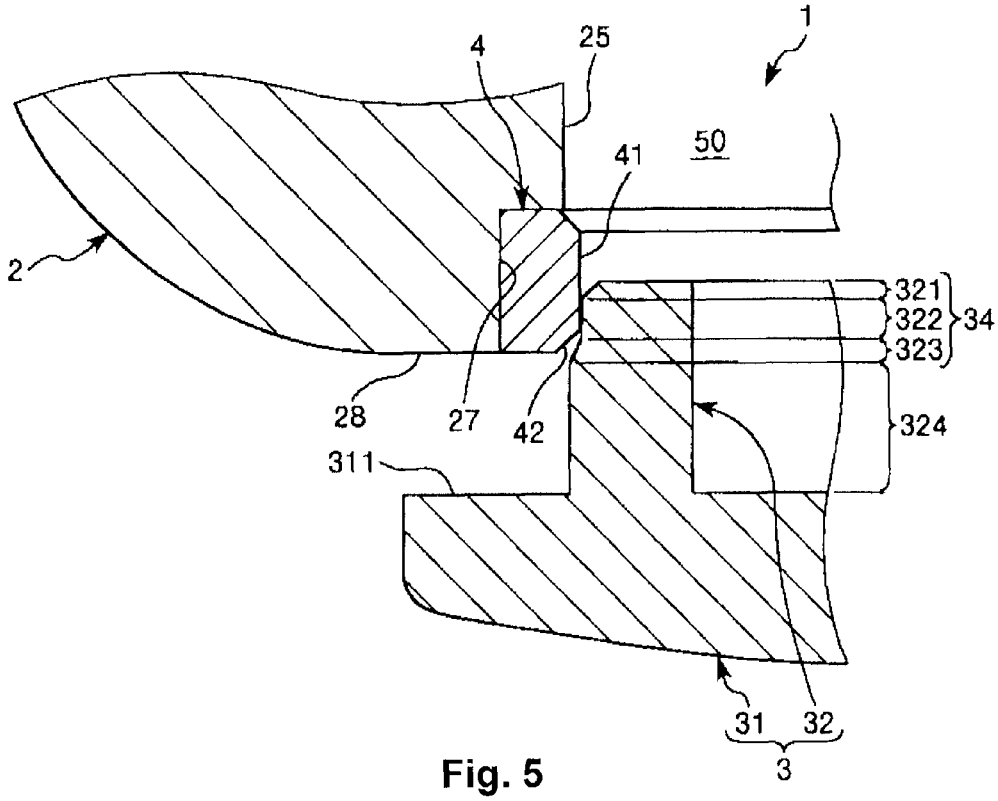
FIG. 5 is an enlarged view of a region [A] surrounded by a single-dashed line in FIG. 2.
Figure 6:
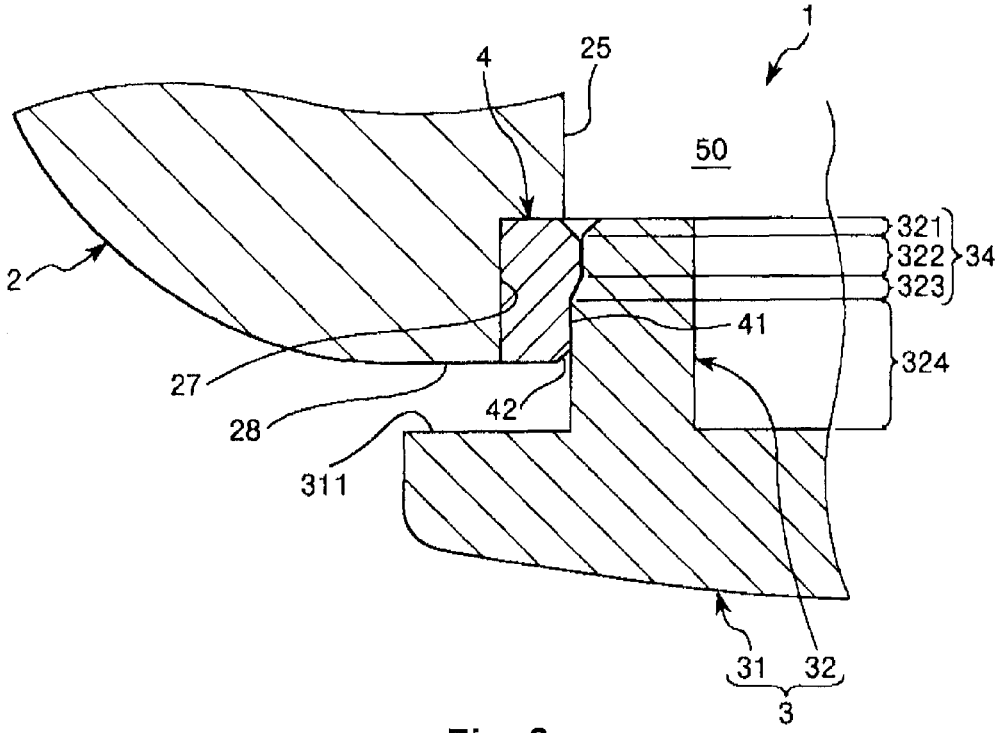
FIG. 6 is an enlarged view of a region [B] surrounded by a single-dashed line in FIG. 3.
Figure 7:
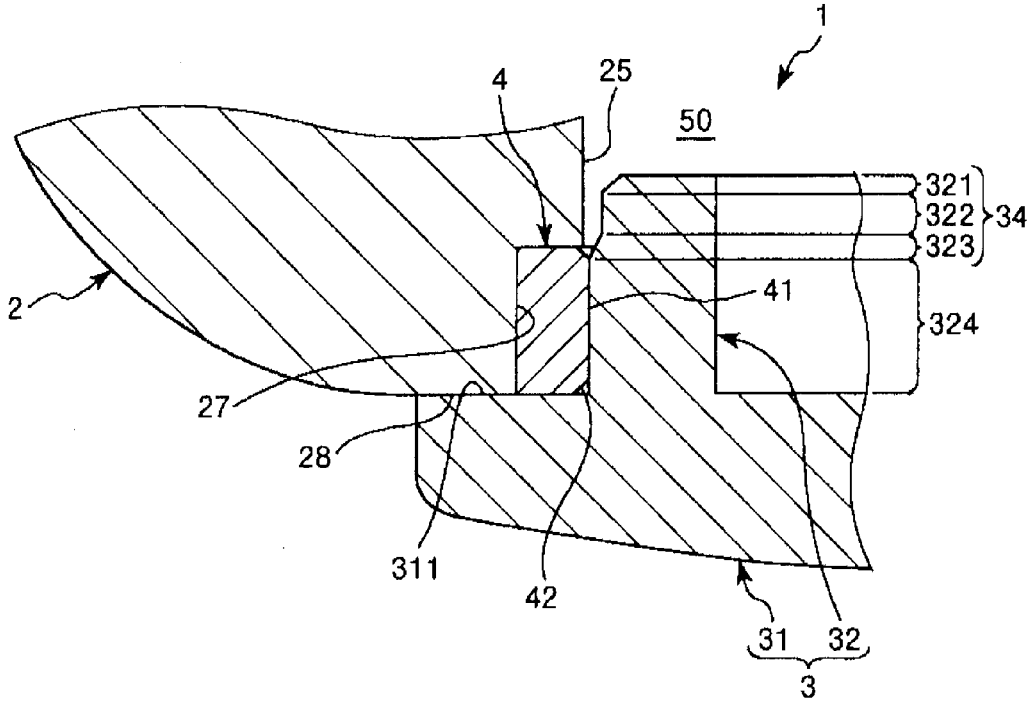
FIG. 7 is an enlarged view of a region [C] surrounded by a single-dashed line in FIG. 4.

FIG. 1 is a perspective view for illustrating a first embodiment of a case where the timepiece of the invention has been adopted in a wristwatch; FIGS. 2-4 are each a cross-sectional view illustrating, in order, a process until a point when a back cover is fixed to a timepiece case via a fixing member in the wristwatch illustrated in FIG. 1; FIG. 5 is an enlarged view of a region [A] surrounded by a single-dashed line in FIG. 2; FIG. 6 is an enlarged view of a region [B] surrounded by a single-dashed line in FIG. 3; and FIG. 7 is an enlarged view of a region [C] surrounded by a single-dashed line in FIG. 4. Hereinbelow, for the sake of convenience of description, the upper side of FIGS. 1-7 (the same also applies to FIGS. 8-14) shall be called "up", "upward", "above", or "top", while the lower side thereof shall be called "down", "downward", "below", or "back".

The wristwatch 1 illustrated in FIG. 1 (hereinbelow referred to simply as a "timepiece 1") is provided with a case (timepiece case) 2, a back cover 3, a bezel 7, a cover glass (windshield) 5, and a band 20. As illustrated in FIGS. 2 to 4, an interior space 50 of the timepiece 1 (a space surrounded by the case 2, the back cover 3, the bezel 7, and the cover glass 5) accommodates a character plate 6, a solar cell 70, and a movement 9, in this order from a side to which the cover glass 5 is provided. An hour hand 101, a minute hand 102, and a second hand 103, which are indicator hands (needles) 10, are rotatably supported on the movement 9. The indicator hands 10 also include a 24-hour hand (small hand) 104 and a day-of-the-week hand (small hand) 105, in addition to the hour hand 101, the minute hand 102, and the second hand 103, and the 24-hour hand 104 and the day-of-the-week hand 105 are also rotatably supported on the movement 9. The indicator hands 10 are accommodated within the interior space 50 of the timepiece 1 together with the movement 9. Provided below is a description of the configuration of each of the parts.

As illustrated in FIGS. 1 to 4, the case 2 is constituted of a member forming an annular shape (a ring shape). The bezel 7 is fitted and fixed onto a portion of a front side of the case 2, and the back cover 3 is fitted and fixed onto a rear side thereof. A winding stem pipe (not shown) is laid into an outer peripheral part 23 of the case 2, and a watch stem 12 is rotatably provided to this winding stem pipe. The watch stem 12 is rotated and operated, whereby the torque thereof is transmitted to the movement 9. The indicator hands 10 are thereby rotatingly driven, and, accordingly, the time being displayed can be adjusted.

The outer peripheral part 23 of the case 2 is provided with lugs 24 serving as connecting parts by which the band 20 is connected on both sides via the central axis thereof. The band 20 is used when the timepiece 1 is being fitted onto a wrist. As illustrated in FIGS. 2 to 4, a first wide diameter part 26 and a second wide diameter part (wide diameter part) 27 both having a widened inner diameter are formed on an inner peripheral part 25 of the case 2.

The first wide diameter part 26 is formed on an upper side portion of the inner peripheral part 25. This first wide diameter part 26 serves as an insertion part where a rib 71 of the bezel 7 (described below) is inserted. The second wide diameter part 27 is formed on a lower side portion of the inner peripheral part 25. This second wide diameter part 27 serves as a fixing member installation part where a fixing member 4 (described below) is installed. The constituent material(s) of the case 2, the back cover 3, the bezel 7, and the indicator hands 10, thought not particularly limited, can be, for example, a variety of metallic materials (including alloys), such as stainless steel, titanium, or titanium alloy. The constituent material of the case, in addition to the aforesaid variety of metallic materials, can also be a ceramic. A case 2 constituted of a ceramic is superior in terms of aesthetic appearance, strength, and the like.

The bezel 7 is constituted of a member forming an annular shape. The rib 71, which runs along a circumferential direction thereof, is formed so as to project out at a lower side portion of the bezel. A packing 80 constituted of a elastic material is disposed in a compressed state between the rib 71 and the first wide diameter part 26 of the case 2. Liquid tightness and air tightness between the bezel 7 and the case 2 are thereby maintained. A reduced diameter part 73 having a reduced inner diameter is formed on an inner peripheral part 72 of the bezel 7. The cover glass 5 can be situated atop this reduced diameter part 73. A packing 90 is disposed in a compressed state between the inner peripheral part 72 of the bezel 7 and an outer peripheral part 51 of the cover glass 5. Liquid tightness and air tightness between the bezel 7 and the cover glass 5 are thereby maintained.

The cover glass 5 is constituted of a transparent member forming an annular shape. A "transparent member" indicates a transparency where the degree of transmittance of visible light is about 50% or greater. The word "transparent" includes not only colorless transparency but also colored (coloring) transparency. Examples of the constituent material of the cover glass 5 are not particularly limited and include inorganic glass and the like. Examples of such inorganic glass include: soda-lime glass, borosilicate glass, Hardlex (reinforced inorganic glass), Clearlex (anti-reflective treatment), spinel glass, or sapphire glass. Inorganic glasses are materials with high strength (strength), and therefore deformation or breakage due to, for example, increased pressure or an impact can be reduced, scratch durability can be imparted, and specularity can also be improved. This makes it possible to increase the strength of the cover glass 5 as well as to improve visibility.

The disc-shaped movement 9 is fixed to the case 2. As illustrated in FIGS. 2 to 4, the movement 9 has: a shaft 91 for rotatingly supporting the hour hand 101, the minute hand 102, and the second hand 103; a shaft (not shown) for rotatingly supporting the 24-hour hand 104, and a shaft 93 for rotatingly supporting the day-of-the-week hand 105. The shaft 91 is disposed at a center part of the movement 9; the other shafts (the shaft 93 and the like) are each disposed at positions different from the shaft 91, i.e., spaced apart about the shaft 91.

The movement 9 uses electrical power supplied from the solar cell 70 to respectively drive (rotate) the hour hand 101, the minute hand 102, and the second hand 103; there is also a built-in mechanism for respectively driving the 24-hour hand 104 and the day-of-the-week hand 105. This mechanism is not particularly limited, and examples therefor include those provided with: an electric double-layer capacitor or lithium ion secondary cell for storing electromotive force for the solar cell 70; a crystal oscillator as a time reference source; a semiconductor integrated circuit for generating a drive pulse for driving the timepiece on the basis of an oscillating frequency of the crystal oscillator; a step motor for receiving this drive pulse and driving the indicator hands every second through a watch train mechanism; and/or a watch train mechanism or the like for transmitting the actuation of the step motor to the indicator hands.

The solar cell 70 forming a disk shape (a plate shape) is installed atop the movement 9. The solar cell 70 is electrically connected to the movement 9, generates electrical power by receiving light, and is able to supply the electrical power to the movement 9. An example which can be used as the solar cell 70 is one in which a p-type semiconductor and an n-type semiconductor are overlaid and bonded. A "p-type semiconductor" is a high-purity silicon semiconductor into which trace amounts of a boron or another trivalent element have been mixed, and an "n-type semiconductor" is a high-purity silicon semiconductor into which trace amounts of arsenic or another pentavalent element have been mixed. When the solar cell 70 having the configuration of such description is irradiated with light, a photoelectric effect causes electrons and holes to be generated inside the silicon. Further, at the p-n junction corresponding to the interface between the p-type semiconductor and the n-type semiconductor, of the electrons and holes generated, the holes, which have a positive charge, are separated and guided toward the p-type semiconductor, and the electrons, which have a negative charge, are separated and guided toward the n-type semiconductor. This makes it possible for each of the semiconductors to have a respective positive or negative charge, thus creating a difference in potential, and electrical power can accordingly be supplied to the movement 9. The vicinity of the p-n junction becomes a depletion layer.

The solar cell 70 has insertion holes 701, through each of the shafts (the shafts 91, 93, and the like) for rotatingly supporting the indicator hands 10 on the movement 9, the insertion holes being formed at positions corresponding to the respective shafts. The character plate 6 is disposed atop the solar cell 70. The character plate 6 is constituted of a member forming a disk shape, and is entirely light-permeable. This makes it possible, when light is irradiated from the front, for this light to be transmitted through the character plate 6. The transmitted light is received by the solar cell 70. Examples which can be used as the constituent material of the character plate 6 are not particularly limited, and can include a plastic material constituted of a material including at least one species selected from polycarbonate (PC) and acrylonitrile-butadiene-styrene copolymer (ABS resin), or can include soda glass or quartz glass.

An insertion hole 63 through which the shafts (the shafts 91, 93, and the like) for rotatingly supporting the indicator hands 10 of the movement 9 are each inserted is formed on the character plate 6. A plurality of first display units (tick marks) 64, to which the hour hand 101, the minute hand 102, and the second hand 103 point, and which have a function for displaying the time, are disposed on the front-side surface of the character plate 6. The first display units 64 are disposed intermittently along the circumferential direction of the character plate 6, and correspond to times "1" to "12". The time can be confirmed by the position at which the hour hand 101, the minute hand 102, and the second hand 103 each point to the first display units 64.

A plurality of second display units (tick marks) 68 are also disposed on the front-side surface of the character plate 6, at portions different from those of the first display units 64. The second display units 68 have numbers "1" to "24" to which the 24-hour hand 104 points and whereby the time can be confirmed. In addition, the second display units 68 also have characters for "Mon (Monday)", "Tue (Tuesday)", "Wed (Wednesday)", "Thu (Thursday)", "Fri (Friday)", "Sat (Saturday)", and "Sunday (Sunday)", to which the day-of-the-week hand 105 points and whereby the day of the week can be confirmed. The back cover 3 is fitted onto the back of the case 2. The fixing member 4 is interposed between the case 2 and the back cover 3. A description of the back cover 3 and of the fixing member 4 shall be provided below.

The description shall first relate to the fixing member 4. The fixing member has a fixing function for fixing the back cover 3 to the case 2. The fixing member 4 is constituted of a member forming an annular shape (a ring shape) running along the circumferential direction of the inner peripheral part 25 of the case 2. The fixing member is pre-installed at a fixing member installation part, constituted of the second wide diameter part 27 of the case 2, i.e., is installed before the back cover 3 is fitted onto the case 2. The outer diameter of the fixing member 4 is set to be substantially equivalent to the inner diameter of the second wide diameter part 27. The fixing member 4 will thereby be engaged into the second wide diameter part 27 and accordingly is reliably fixed to the second wide diameter part 27.

The fixing member 4 is constituted of, for example, a thermoplastic resin, which is a resin material, and examples of this thermoplastic resin include polyethylene, polypropylene, ethylene-vinyl acetate copolymer, or another polyolefin; a modified polyolefin, a polyamide (for example: nylon 6, nylon 46, nylon 66, nylon 610, nylon 612, nylon 11, nylon 12, nylon 6-12, or nylon 6-66); a thermoplastic polyimide; an aromatic polyester or other liquid crystal polymer; polyphenylene oxide, polyphenylene sulfide, polycarbonate, polymethyl methacrylate, polyether, polyether ether ketone, polyether imide; a polyacetal, styrene-based, polyolefin-based, polyvinyl chloride-based, polyurethane-based, polyester-based, polyamide-based, polybutadiene-based, trans-polyisopropylene-based, fluorine rubber-based, or chlorinated polyethylene-based thermoplastic elastomer, or a variety of other thermoplastic elastomers; alternatively, a copolymer, blend, or polymer alloy primarily composed thereof; these can be used independently, or a mixture of two or more types can be used. The use of a resin material of such description makes it possible for the fixing member 4 to be deformed when compressed between the case 2 and the back cover 3, as shall be described below, but also to reliably create reaction force attempting to return to the original shape at such a time, thus fulfilling the fixing function.

A description of the back cover 3 shall now be provided. As illustrated in FIGS. 2 to 4, the back cover 3 has a main body part 31 forming a disc shape, and a rib (projecting part) 32 formed so as to project out at a front-side surface 311 of the main body part 31. With respect to the main body part 31, when the back cover 3 has been fitted onto the case 2, the front-side surface 311 abuts against a back-side surface 28 of the case 2. The position of the back cover 3 in the width direction of the timepiece 1 is thereby regulated.

The rib 32 forms an annular shape (ring shape) running along an edge part of the main body part 31 (the back cover 3). This makes it possible for the rib 32 to reliably cause the entirety of the fixing member 4 to be compressed and deformed against the second wide diameter part 27 of the case 2, and accordingly possible for the fixing function of the fixing member 4 to be more reliably fulfilled. As illustrated in FIGS. 5 to 7, the outer diameter of the rib 32 has a gradual increase. In other words, the rib 32 has a first taper part 321, a first constant wide diameter part 322, a second taper part 323, and a second constant outer diameter part 324 formed in this order from above.

The first taper part 321 is formed on an upper part of an outer peripheral part 32, and is a portion where the outer diameter thereof is reduced going upward. The first constant outer diameter part 322 is formed directly beneath the first taper part 321, and is a portion having a constant outer diameter. The outer diameter of the first constant outer diameter part 322 is the same as the maximum outer diameter of the first taper part 321.

The second taper part 323 is formed directly below the first constant outer diameter part 322, and is a portion where the outer diameter thereof is reduced going upward. The minimum outer diameter of the second taper part 323 is the same as the outer diameter of the first constant outer diameter part 322. The second constant outer diameter part 324 is formed directly below the second taper part 323, and is a portion having a constant outer diameter. The outer diameter of the second constant outer diameter part 324 is the same as the maximum outer diameter of the second taper part 323. The outer diameter of the second constant outer diameter part 324 is set to be slightly larger (for example, 0.3-1%) than the inner diameter of the fixing member 4 prior to when the back cover 3 is fitted onto the case 2, i.e., in a natural state where no external force is applied.

During the process as the back cover 3 is being fitted onto the case 2, the first taper part 321, the first constant outer diameter part 322, and the second taper part 323 of the rib 32 of the back cover 3 are guided in this order to an inner peripheral part 41 of the fixing member 4 (see FIGS. 5 and 6). In this manner, when the back cover 3 is fitted onto the case 2, the first taper part 321, the first constant outer diameter part 322, and the second taper part 322 function as guide parts 34 for guiding the rib 32 to the inner peripheral part 41 of the fixing member 4.

A lower part of the inner peripheral part 41 of the fixing member 4 is beveled, thus forming a beveled part 42. During the process where the back cover 3 is being fitted onto the case 2, the beveled part 42, too, functions as a guide part for guiding the rib 32 to the inner peripheral part 41 of the fixing member 4. This manner of configuration such that the rib 32 is guided to the inner peripheral part 41 of the fixing member 4 makes it possible to readily perform the task of fitting the back cover 3 onto the case 2 during the production of the assembly of the timepiece 1.

The second constant outer diameter part 324 is set such that the outer diameter thereof is slightly larger than the inner diameter of the fixing member 4, as has already been described, and the fixing member 4 can be proportionately compressed against the second wide diameter part 27 of the case 2 (see FIG. 7). In this manner, the second constant outer diameter part 324 functions as a compression part for compressing the fixing member 4. The fixing member 4, having been compressed, is deformed in the width direction (in the left-right direction in FIG. 7). At such a time, there occurs in the fixing member 4 a reaction force attempting to return to the original shape. The engaging force (fixing force) between the fixing member 4 and the back cover 3 is increased by this reaction force, and the back cover 3 is thereby reliably fixed to the case 2. In this manner, the fixing member 4 can be compressed and deformed and thereby fulfill the fixing function.

According to the timepiece 1, pushing the rib 32 of the back cover 3 into the fixing member 4 installed on the case 2 is a simple task which makes it possible to readily and reliably fit the back cover 3 onto the case 2. As such, the timepiece 1 can be considered to be easy to assemble and produce. Further, as has been described above, the movement 9 of the timepiece 1 drives using the electrical power from the solar cell 70. For this reason, unlike the fact that, in a well-known timepiece, the back cover 3 is repeatedly attached and detached in order to replace the power cell, the timepiece 1 makes it possible to forgo the task of removing and then again re-fitting the back cover 3 having once been fitted on. A configuration for fixing the back cover 3 to the case 2 via the fixing member 4 can be used for the timepiece 1 of such description.

The case 2, when constituted of, for example, a ceramic, is a harder material than the fixing member 4. However, a ceramic is generally a brittle material, and therefore when the back cover 3 is engaged directly with and fitted onto the case 2 constituted of a ceramic, the case 2 can in some cases suffer cracks or the like during this engagement. By contrast, according to the timepiece 1, the back cover 3 is configured so as to be fixed to the case 2 via the fixing member, which is constituted of a resin material. The configuration of such description is preferable in that the case 2 can be reliably prevented from suffering such cracks or the like even when the case 2 is constituted of a ceramic. Fixing both the case and the back cover via a bolt, as is done in a well-known timepiece, causes the head of the bolt (the screw head) to be exposed, and this is aesthetically lacking, i.e., is not a favorable appearance. By contrast, the timepiece 1 is aesthetically superior, because there is no fixation by a bolt.

Second Embodiment

Figure 8:
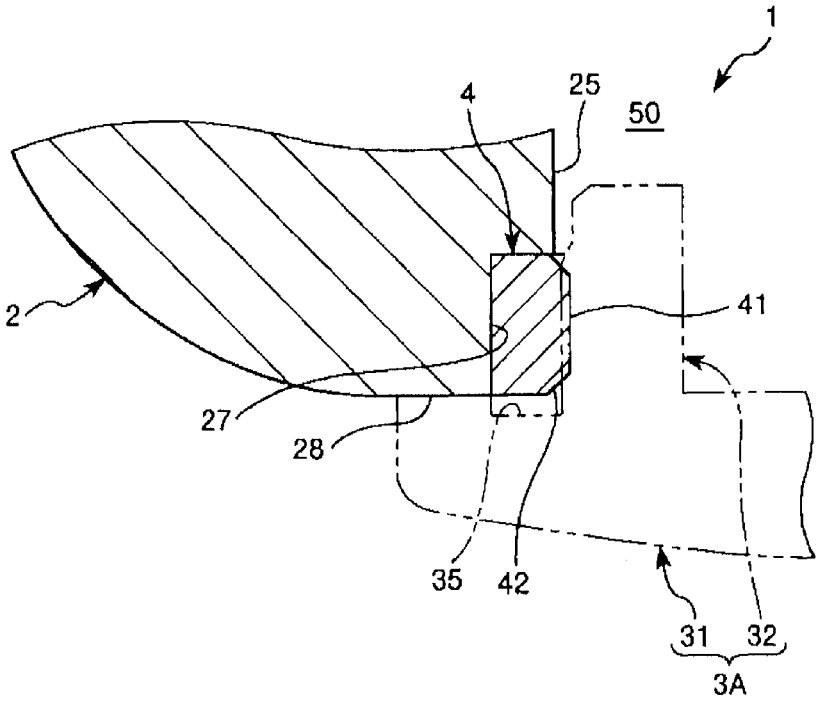
FIG. 8 is a cross-sectional view illustrating, in order, a process until a point when a back cover is fixed to a timepiece case via a fixing member in a second embodiment, which is a case where the timepiece of the invention has been adopted in a wristwatch.
Figure 9:
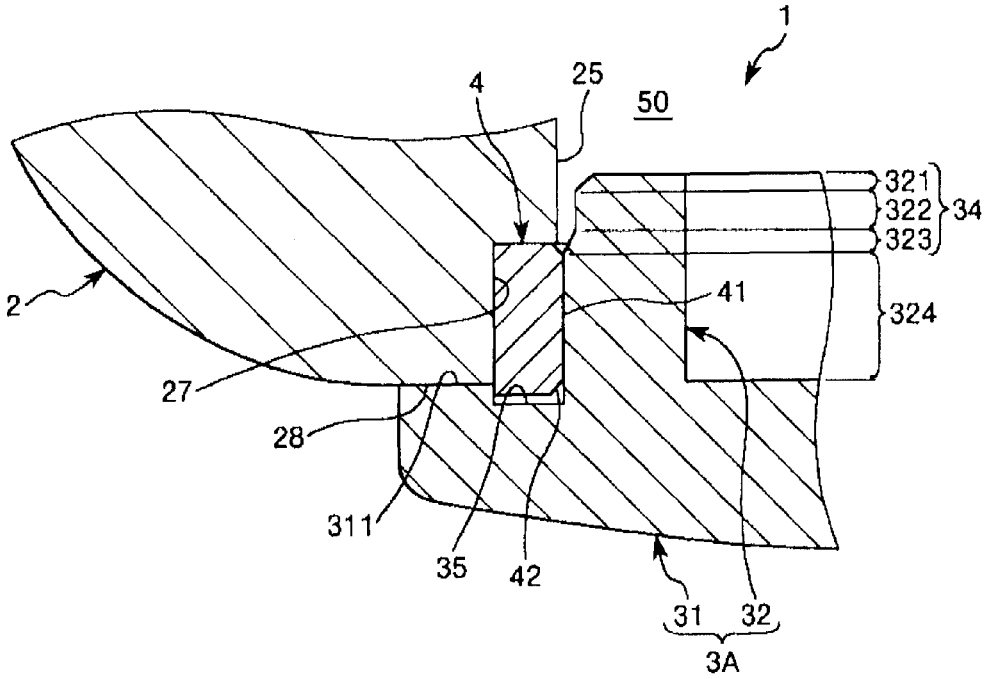
FIG. 9 is a cross-sectional view illustrating, in order, the process until the point when the back cover is fixed to the timepiece case via the fixing member in the second embodiment, which is the case where the timepiece of the invention has been adopted in a wristwatch.

FIGS. 8 and 9 are each a cross-sectional view illustrating, in order, a process until a point when the back cover is fixed to the timepiece case via the fixing member in a second embodiment, which is a case where the timepiece of the invention has been adopted in a wristwatch. Hereinbelow, a description of the second embodiment of the timepiece of the invention shall now be provided, with reference to FIGS. 8 and 9; however, the description shall focus on points of disparity from the embodiment described above, and a description of matters of similarity shall be forgone.

The present embodiment is similar to the first embodiment except in that the configuration of the back cover is different. As illustrated in FIGS. 8 and 9, according to a back cover 3A of the timepiece 1 of the present embodiment, a concave part 35 is formed on the front-side surface 311 of the main body part 31. The concave part 35 is formed on an outer peripheral side of the rib 32, in a ring shape running along the circumferential direction thereof. When the fixing member 4 is compressed and deformed between the rib 32 and the second wide diameter part 27 of the case 2, a part of the fixing member 4, i.e., however much of the fixing member 4 is deformed, enters into the concave part 35. The concave part 35 of such description functions as an "escape space" into which the deformed part of the fixing member 4 enters.

Having the concave part 35 be formed as described above makes it possible to prevent the fixing member 4 from deforming excessively. Such a configuration is also useful in a case where there is a desire to suppress any increase in the fixing force between the back cover 3 and the case 2 imparted by the fixing member 4, i.e., in a case where there is a desire to mitigate the fixing force between the back cover 3 and the case 2 imparted by the fixing member 4. The "concave part" into which the part of the fixing member 4 enters when the fixing member 4 is compressed and depressed is formed in the present embodiment on the back cover 3A, but there is no limitation thereto, and the concave part can be formed, for example, on the case 2, or can be formed on both the case 2 and the back cover 3A.

Third Embodiment

Figure 10:
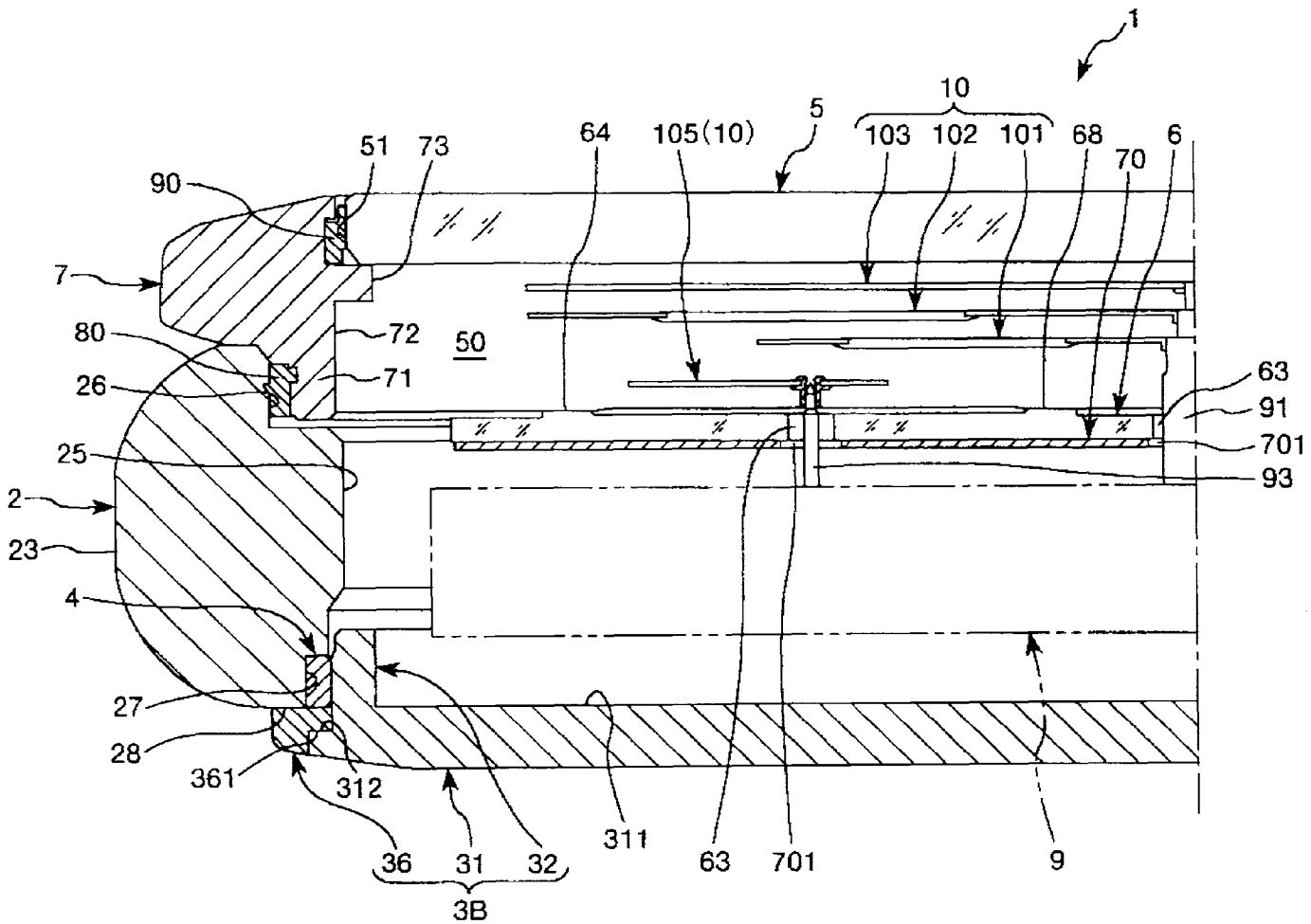
FIG. 10 is a cross-sectional view illustrating a third embodiment, which is a case where the timepiece of the invention has been adopted in a wristwatch.

FIG. 10 is a cross-sectional view illustrating a third embodiment, which is a case where the timepiece of the invention has been adopted in a wristwatch. Hereinbelow, a description of the third embodiment of the timepiece of the invention shall now be provided, with reference to FIG. 10; however, the description shall focus on points of disparity from the embodiments described above, and a description of matters of similarity shall be forgone. The present embodiment is similar to the first embodiment except in that the configuration of the back cover is different.

As illustrated in FIG. 10, a back cover 3B of the timepiece 1 of the present embodiment is constituted of a plurality of members constituted of mutually separate bodies, i.e., has, in addition to the main body part 31 and the rib 32, a frame member 36 disposed on the outer peripheral part of the main body part 31. The main body part 31 and the rib 32 are formed integrally together. The frame member 36, which is constituted of a separate body from that of the main body part 31, is joined to the main body part 31. There is no particular limitation to the method for this joining, examples of which include a method by fusion-bonding (heat fusion-bonding, high-frequency fusion-bonding, ultrasonic fusion-bonding, and the like), a method by adhesion (adhesion using an adhesive agent or a solvent), or a method by mated engagement.

A step part 312, the thickness of which is deformed in a stepwise manner, is formed on the outer peripheral part of the main body part 31. A step part 361, the thickness of which is deformed in a stepwise manner, is also formed on an inner peripheral part of the frame member 36. The main body part 31 and the frame member 36 are bonded together such that the step parts 312, 361 are mated with each other. In a case where, for example, the timepiece 1 is an electronic timepiece having a radiowave receiver function (a radio timepiece), electrical eddy currents will occur in the back cover 3B. A property of electrical eddy currents resides in changing, i.e., in becoming larger or becoming smaller, in accordance with the magnitude of volume of a member in which an electrical eddy current occurs. For this reason, it is preferable that the size of a member in which an electrical eddy current occurs be as small as possible.

As has been described above, the whole of the back cover 3B is divided as much of possible, the back cover thus being constituted of a plurality of members. Thereby, even though electrical eddy currents can occur on a plurality of points on the back cover 3B, i.e., on both the main body part 31 and the frame member 36, each of the electrical eddy currents is made to be comparatively smaller. The configuration of the back cover 3B in which the plurality of members are bonded to each other is useful for a timepiece with which there is a desire to suppress as much as possible any electrical eddy currents, as is true of the electronic timepiece.

Fourth Embodiment

Figure 11:
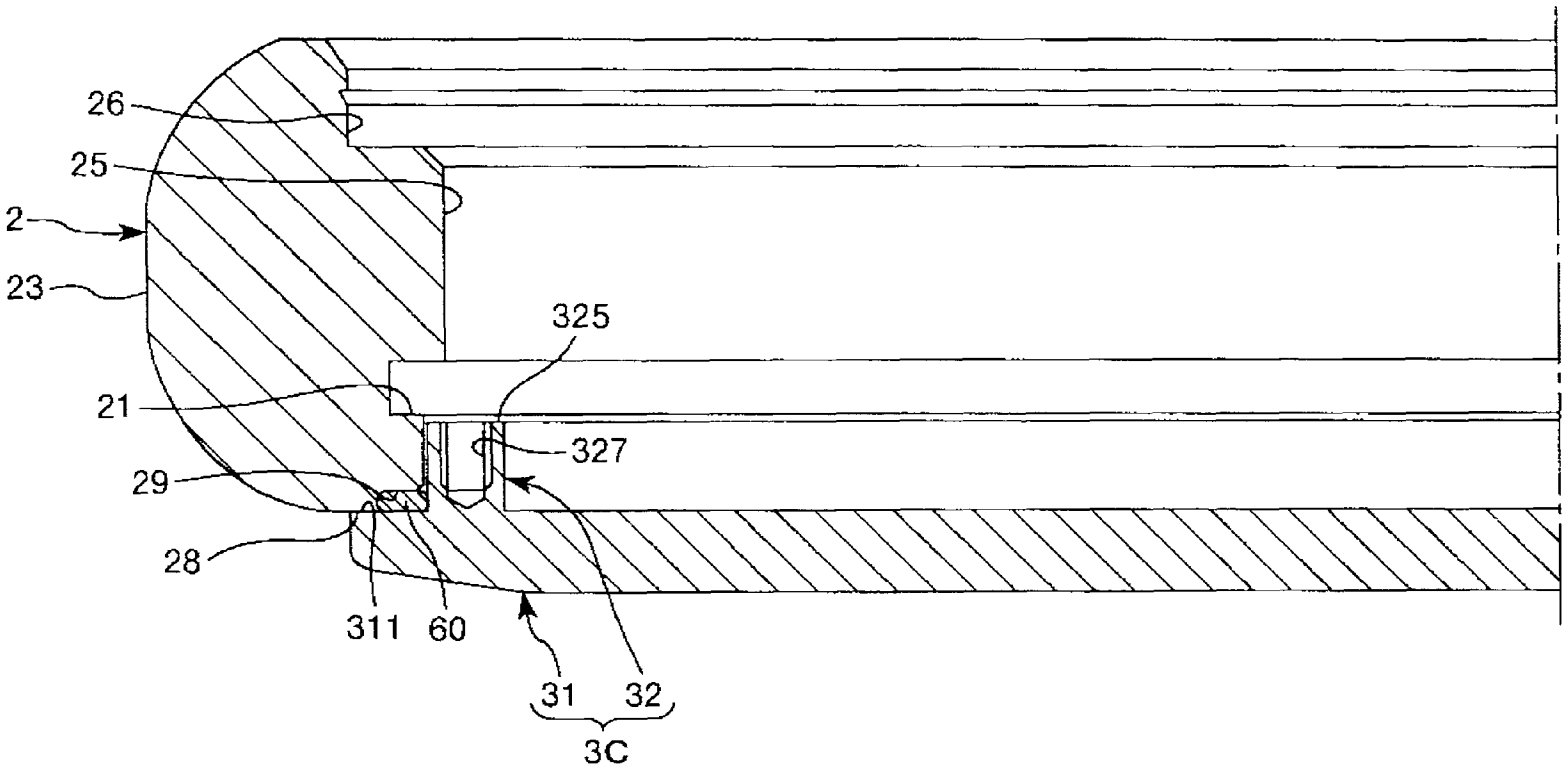
FIG. 11 is a cross-sectional view illustrating, in order, a process for assembling a wristwatch in which the timepiece of the invention has been adopted (a fourth embodiment)
Figure 12:
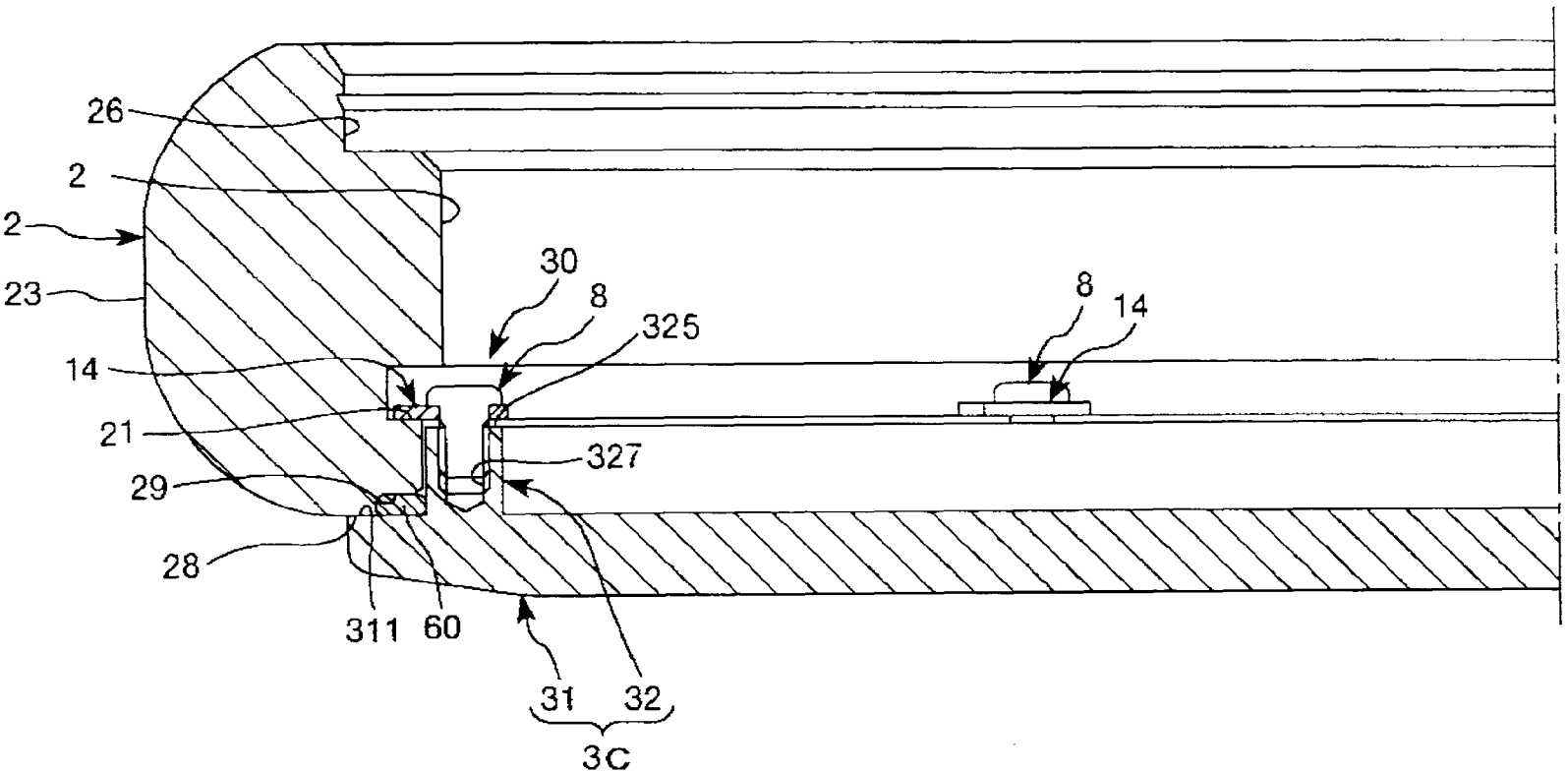
FIG. 12 is a cross-sectional view illustrating, in order, the process for assembling the wristwatch in which the timepiece of the invention has been adopted (the fourth embodiment)
Figure 13:
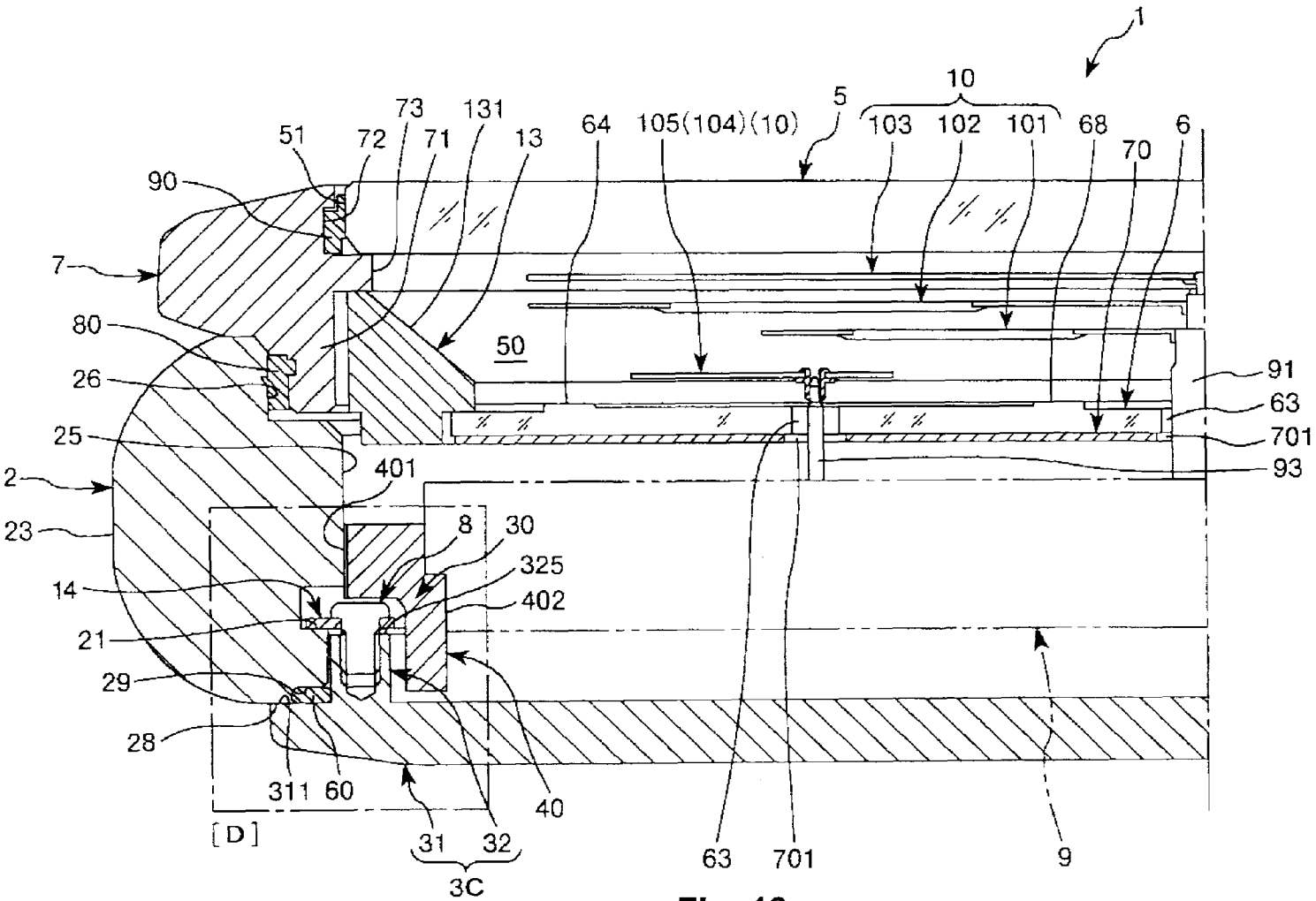
FIG. 13 is a cross-sectional view illustrating, in order, the process for assembling the wristwatch in which the timepiece of the invention has been adopted (the fourth embodiment)
Figure 14:
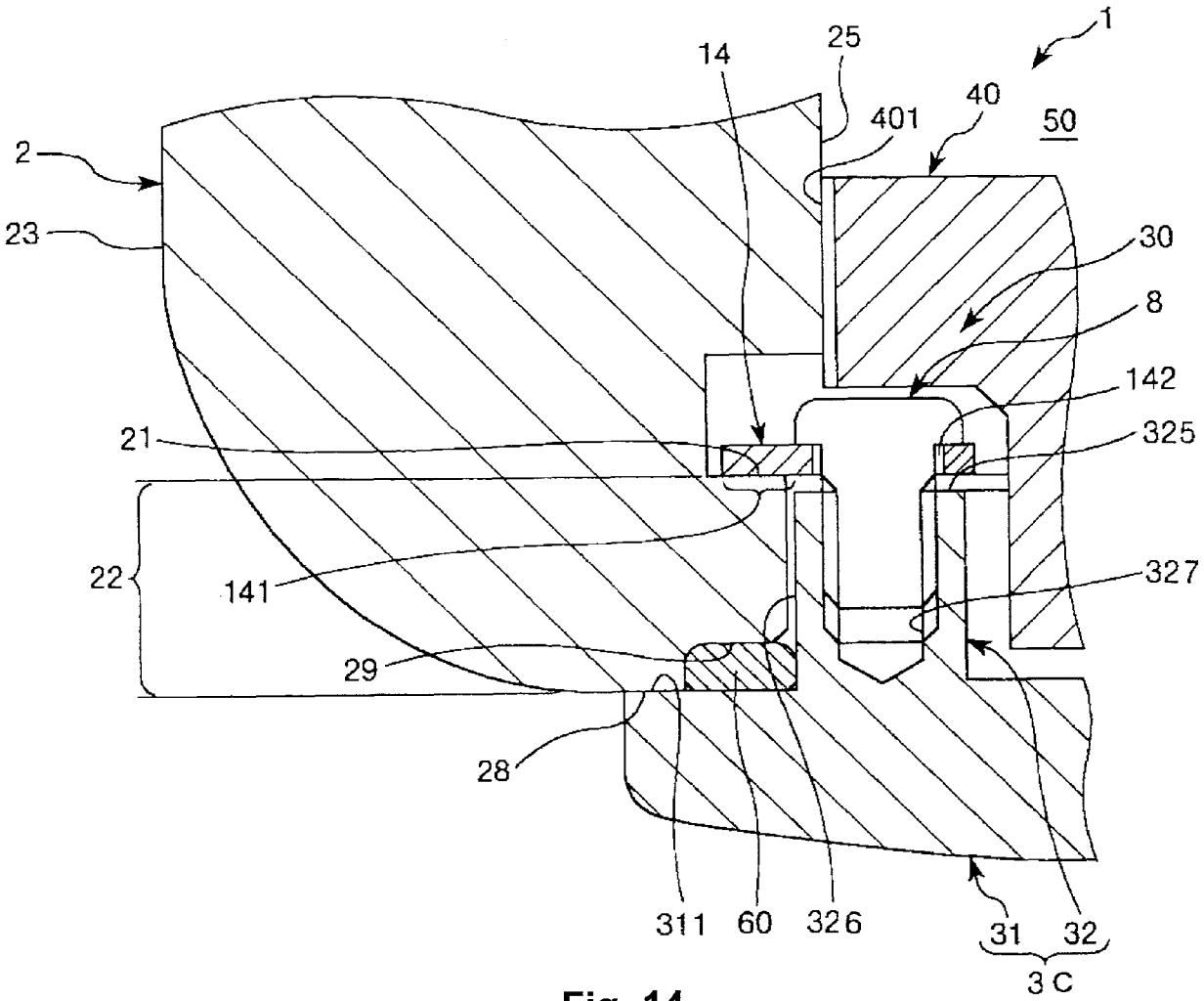
FIG. 14 is an enlarged view of a region [D] surrounded by a single-dashed line in FIG. 13.

FIGS. 11 to 13 are each a cross-sectional view illustrating, in order, a process for assembling a wristwatch in which the timepiece of the invention has been adopted (a fourth embodiment); FIG. 14 is an enlarged view of a region [D] surrounded by a single-dashed line in FIG. 13. Hereinbelow, a description of the fourth embodiment of the timepiece of the invention shall now be provided, with reference to FIGS. 11 to 14; however, the description shall focus on points of disparity from the embodiments described above, and a description of matters of similarity shall be forgone. The present embodiment is similar to the first embodiment except in that the configuration for fixing the back cover to the timepiece case is different.

As illustrated in FIGS. 12 to 14, in the timepiece 1 of the present embodiment, a back cover 3C is fixed to the case 2 via a fixing means 30.

The disc-shaped movement 9 is fixed to the case 2 via a movement fixing member 40. The movement fixing member 40 forms a ring shape, an outer peripheral part 40 thereof engaging the inner peripheral part 25 of the case 2 and an inner peripheral part 402 thereof engaging the outer peripheral part of the movement 9. The movement 9 is thereby reliably fixed to the case 2 via the movement fixing member 40.

As illustrated in FIG. 13, a ring member (a dial ring) 13 forming an annular shape is interposed between the character plate 6 and the reduced diameter part 73 of the bezel 7. The ring member 13 makes it possible to regulate, for example, the position of the character plate 6 in the thickness direction of the timepiece 1. The thickness of the ring member 13 is gradually reduced toward the inside; an inclined surface 131 is thereby formed. It is possible to endow the inclined surface 131 with, for example, a tick mark. This makes it possible for the ring member to have a function for serving as a character plate.

The back cover 3C is fitted onto the back of the case 2. As illustrated in FIGS. 11 to 14, the back cover 3C has the main body part 31 forming the disc shape, and the rib (projecting part) formed so as to project out at the front-side surface 311 of the main body part 31. With respect to the main body 31, when the back cover 3C has been fitted onto the case 2, the front-side surface 311 abuts against the back-side surface 28 of the case 2. The position of the back cover 3C in the width direction of the timepiece 1 is thereby regulated. A concave part 29 is formed on the back-side surface 28 of the case 2. A packing 60 constituted of an elastic material is installed on the concave part 29. The packing 60 adopts a state of being compressed between the concave part 29 and the front-side surface 311 of the main body part 31. The liquid tightness and air tightness between the case 2 and the back cover 3C are thereby maintained.

The rib 32 forms an annular shape (ring shape) running along an edge part of the main body part 31 (the back cover 3C). This makes it possible to a plurality of engaging pieces 14, described below, to be installed at equal intervals atop the rib 32 along the circumferential direction thereof, i.e., makes it possible to dispose the engaging pieces 14 at equal angular intervals about a central axis of the case 2. Installing the engaging pieces 14 in this manner makes it possible to evenly distribute the engaging force imparted by the engaging pieces 14, and accordingly the back cover 3C is stably and reliably fitted onto the case 2.

The case 2 and the back cover 3C can be constituted of the same material as each other, but are preferably constituted of mutually different materials. In such a case, the case 2 can be constituted of a ceramic, and the back cover 3C can be constituted of the aforementioned variety of metallic materials. According to the timepiece 1, in this manner, it is possible to make the constituent materials of each of the members (the case 2 and the back cover 3C) different because the case 2 and the back cover 3C are constituted of separate bodies. It is also possible to use constituent materials adapted for each of the members. More specifically, it is possible to use a ceramic, which is aesthetically superior, for the constituent material of the case 2, and possible to use, for example, stainless steel, which is able to earth (ground) the movement 9, for the back cover 3C.

By contrast, according to a well-known wristwatch in which the case (the timepiece case) and the back cover are formed integrally together, it is difficult to use distinct constituent materials for the case and the back cover. For example, in a case where a ceramic is used for the constituent material, the case and the back cover are constituted of a ceramic en bloc, and in a case where stainless steel is used for the constituent material, the case and the back cover are constituted of stainless steel en bloc.

As illustrated in FIGS. 12 to 14, the fixing means 30 for fixing the back cover 3C to the case 2 has a plurality of engaging pieces 14 arranged within the interior space 50, a bolt function as a fixing member for fixing each of the engaging pieces 14 within the interior space 50, and an engaging part 21 which is provided to the case 2 and with which each of the engaging pieces 14. Each of the engaging pieces 14 is constituted, for example, of a plate piece (small piece) forming a strip shape. There is no particular limitation to the constituent material of the engaging pieces 14, examples of which can include comparatively hard metallic materials such as stainless steel or the like.

As illustrated in FIG. 12, each of the engaging pieces 14 is disposed at equal intervals atop a top part 325 of the rib 32 of the back cover 3C, along the circumferential direction thereof. As illustrated in FIG. 14, each of the engaging pieces 14 has a part projecting outward further than an outer peripheral part 326 of the rib 32 (hereinbelow, the portion projected outward shall be called the "projecting part 141"). Disposing each of the engaging pieces 14 in this manner makes it possible for the projecting parts 141 to reliably engaging the engaging part 21 of the case 2.

Each of the engaging pieces 14 has a through hole 142 penetrating through the thickness direction thereof, formed on the opposite side portion of the projecting part 141. A bolt 8 is inserted into the through hole 142. Each of the bolts 8 is a fixing member for fixing the engaging pieces 14 to the rib 32 of the back cover 3C. As illustrated in FIG. 14, the top part 325 of the rib 32 has internal screw threads 327 in which the bolts 8 are screwed, formed at the positions at which each of the engaging pieces 14 are arranged. Causing the bolt 8, having been inserted through the through hole 142 of the engaging piece 14, to be screwed into the internal screw thread 327 reliably fixes the engaging piece 14 to the rib 32. Using the bolts 8 as fixing members in this manner makes it possible to readily and reliably fix the engaging pieces through a simple configuration (task) of "screwing together".

The engaging part 21 is constituted of a concave part formed on the inner peripheral part 25 of the case 2, in a ring shape running along the circumferential direction thereof. Each of the engaging pieces 14 face the engaging parts 21, with which the projecting parts 141 are able to engaging (see FIG. 14). As illustrated in FIG. 14, each of the engaging pieces 14, each of the engaging pieces 14 is able to sandwich a part of the case 2 against an edge part (the front-side surface 311) of the main body part 31 of the back cover 3C, i.e., in the configuration depicted, is able to sandwich a portion 22 between the back-side surface 28 of the case 2 and the engaging part 21. The fixing function in the fixing means 30 is thereby enhanced, i.e., the fixing force is thereby increased. Accordingly, the back cover 3C having been fitted onto the case 2 can be reliably prevented from an unintended detachment from the case 2.

Due to the fixing means 30 having the configuration of such description, the bolt 8 for fixing the case 2 and the back cover 3C together is arranged within the interior space 50 and cannot be visible from the outside. This allows the timepiece 1 to have a superior aesthetic appearance and an enhanced beauty. By contrast, in a case where, as with a well-known wristwatch, a bolt is tightened from the outside of the case toward the back cover to fix the case and the back cover together, a head part of this bolt (the screw head) will be exposed. For this reason, the aesthetic appearance of the well-known wristwatch is undermined, and there is a loss of beauty, i.e., the appearance is not favorable. The fixing means 30 is a useful configuration also in a case where there is a desire for the constituent materials of the case 2 and the back cover 3C to be different.

A description of the order of assembly when the timepiece 1 is assembled shall now be provided, with reference to FIGS. 11 to 13.

[1] As illustrated in FIG. 11, the case 2 and the back cover 3C are prepared, and the back cover 3C is temporarily fitted on from the back side of the case 2. At this time, the packing 60 is disposed in advance on the concave part 29 of the case 2. The packing 60 is thereby compressed between the case 2 and the back cover 3C.

[2] Next, as illustrated in FIG. 12, each of the engaging pieces 14 is disposed at a predetermined position on the rib 32 of the back cover 3C, i.e., at a position where the internal screw thread 327 has been formed. In this state, each of the engaging pieces 14 is fixed using the bolts 8. As has been described above, each of the engaging pieces 14 thereby engages the engaging parts 21 of the case 2, and the back cover is accordingly properly fitted (fixed) onto the case 2. It is substantially impossible to detach the back cover 3C from the case 2 even when, for example, pulled from the outside (from the back side).

[3] Next, as illustrated in FIG. 13, a unit in the state where the movement 9, the solar cell 70, and the character plate 6 have been pre-assembled (a module) is accommodated from the front side in the space surrounded by the case 2 and the back cover 3C; thereafter, the ring member 13 is disposed thereabove. The bezel 7, onto which the glass cover 5 has been pre-fitted, is fixed to the case 2.

The timepiece 1 is assembled by performing the tasks of such description in this order. A ceramic is in general a brittle material, and in a case where the case 2 is constituted of such a ceramic, the case 2 can in some cases suffer cracks or the like when the configure is such that the back cover 3C is directly engaged with and fitted onto the case 2. However, according to the timepiece 1, the back cover 3C is configured so as to be fixed to the case 2 via the fixing means 30. The configuration of such description is preferable in that the case 2 can be reliably prevented from suffering such cracks or the like even when the case 2 is constituted of a ceramic.

Further, as has been described above, the movement 9 of the timepiece 1 drives using the electrical power from the solar cell 70. For this reason, unlike the fact that, in a well-known timepiece, the back cover 3C is repeatedly attached and detached in order to replace the power cell, the timepiece 1 makes it possible to forgo the task of removing and then again re-fitting the back cover 3C having once been fitted on. The fixing means 30, whereby it is substantially impossible to detach the back cover 3C from the case 2 even when, for example, pulled from the outside, is a useful configuration for the timepiece 1 of such description.

A description of the timepiece of the invention has been provided above with respect to the depicted embodiments, but the invention is in no way limited thereto, and each of the parts constituting the timepiece can be replaced with any desired configuration able to fulfill a similar function. Any desired constituent article can also be added. Further, the timepiece of the invention can be a combination of any two or more desired configurations (features) from among each of the aforementioned embodiments. In the first through third embodiments, the projecting part of the back cover and the fixing member has the guide parts for guiding the projecting part toward the inner peripheral part of the fixing member when the back cover is being fitted onto the timepiece case, but there is no limitation thereto, and only one of either the fixing member or the back cover can also have the guide part. The fixing means for fixing the back cover to the timepiece case in the fourth embodiment is configured to have the plurality of the engaging pieces in the embodiment, but there is no limitation thereto, and a configuration can be adopted in which, for example, the fixing means has one engaging piece forming a ring shape. The fixing means in the fourth embodiment has the engaging pieces disposed on the back cover and the engaging parts into which the engaging pieces engage provided to the timepiece case, but there is no limitation thereto, and, for example, the engaging pieces can be disposed on the timepiece case, and the engaging parts can be disposed on the back cover.

What is claimed is:

1. A timepiece comprising:

a timepiece case forming a ring shape;

a back cover having a projecting part that projects on a front-side surface of the back cover; and a fixing member for fixing the back cover to the timepiece case, the fixing member forming a ring shape that extends along a peripheral direction of an inner peripheral part of the timepiece case, the timepiece case being made of a harder material than the fixing member, the fixing member being compressed and deformed between the inner peripheral part of the timepiece case and the projecting part of the back cover, the projecting part of the back cover having a first taper part, a first constant outer diameter part, a second taper part, and a second constant outer diameter part in this order in a first direction directing from a front side of the timepiece to a back side of the timepiece, the first taper part being formed on a front-side part of an outer peripheral part of the projecting part and having an outer diameter gradually increasing as moving in the first direction, the first constant outer diameter part being formed directly next to the first taper part in the first direction with respect to the first taper part and having a constant outer diameter equal to a maximum outer diameter of the first taper part, the second taper part being formed directly next to the first constant outer diameter part in the first direction with respect to the first constant outer diameter part and having an outer diameter gradually increasing as moving in the first direction, a minimum outer diameter of the second taper part being equal to the outer diameter of the first constant outer diameter part, and the second constant outer diameter part being formed directly next to the second taper part in the first direction with respect to the second taper part and having a constant outer diameter equal to a maximum outer diameter of the second taper part.

2. The timepiece as set forth in claim 1, wherein:

the inner peripheral part of the timepiece case has an inner peripheral surface, the back cover is mounted onto a back side of the timepiece case, with the projecting part of the back cover having an outer peripheral surface, the fixing member being radially sandwiched between the inner peripheral surface of the timepiece case and the outer peripheral surface of the back cover such that the fixing member directly contacts with the inner peripheral surface of the timepiece case and the outer peripheral surface of the back cover while the back cover is fixedly coupled to the timepiece case, and such that the fixing member is compressed and deformed between the inner peripheral surface of the timepiece case and the outer peripheral surface of the back cover for exerting a fixing function between the timepiece case and the back cover.

3. The timepiece as set forth in claim 2, wherein:

the fixing member is fixed to the inner peripheral part of the timepiece case; and the fixing member and/or the projecting part has a guide part for guiding the projecting part to the inner peripheral part of the fixing member when the back cover is being mounted onto the timepiece case.

4. The timepiece as set forth in claim 2, wherein:

the projecting part is a portion forming a ring shape that extends along an edge part of the back cover.

5. The timepiece as set forth in claim 2, wherein:

the timepiece case has a fixing member installation part as a part of the timepiece case, the fixing member installation part including a wide diameter part where an inner diameter has been widened in the inner peripheral part of the timepiece case, the fixing member installation part being where the fixing member is installed.

6. The timepiece as set forth in claim 2, wherein:

a concave part into which a part of the fixing member enters when the fixing member has been compressed and deformed is formed on the timepiece case and/or the back cover.

7. The timepiece as set forth in claim 2, wherein:

the timepiece case is constituted of a ceramic or metal material, and the fixing member is constituted of a resin material.

8. The timepiece as set forth in claim 2, wherein:

the back cover includes a plurality of mutually different bodies that are bonded relative to each other.

9. The timepiece as set forth in claim 2, wherein:

the projecting part of the back cover has a base part that radially directly contacts with the fixing member, and an end part that has a smaller outer diameter than the base part.

10. The timepiece as set forth in claim 1, wherein:

the constant outer diameter of the second constant outer diameter part is larger than an inner diameter of the fixing member in a state prior to the back cover is attached to the timepiece case via the fixing member.

* * * * *